US009745717B2

(12) United States Patent
Sakata et al.

(10) Patent No.: US 9,745,717 B2
(45) Date of Patent: Aug. 29, 2017

(54) CONSTRUCTION MACHINE

(71) Applicant: KOBELCO CONSTRUCTION MACHINERY CO., LTD., Hiroshima-shi (JP)

(72) Inventors: Tomohiro Sakata, Hiroshima (JP); Seiji Saiki, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 18 days.

(21) Appl. No.: 14/728,060

(22) Filed: Jun. 2, 2015

(65) Prior Publication Data

US 2015/0376866 A1 Dec. 31, 2015

(30) Foreign Application Priority Data

Jun. 25, 2014 (JP) ..... 2014-130265

(51) Int. Cl.
*E02F 9/08* (2006.01)
*E02F 9/10* (2006.01)

(52) U.S. Cl.
CPC ..... *E02F 9/0808* (2013.01); *E02F 9/0816* (2013.01); *E02F 9/10* (2013.01)

(58) Field of Classification Search
CPC ..... E02F 9/0816; E02F 9/0808; E02F 9/0858
See application file for complete search history.

(56) References Cited

U.S. PATENT DOCUMENTS

2010/0032985 A1* 2/2010 Yamamoto ..... E02F 9/163 296/190.08
2013/0026795 A1 1/2013 Shimomura et al.
(Continued)

FOREIGN PATENT DOCUMENTS

| | | | |
|---|---|---|---|
| JP | H10-088617 | A | 4/1998 |
| JP | 2000-104284 | A | 4/2000 |
| JP | 2001-342646 | A | 12/2001 |
| JP | 2011-179165 | A | 9/2011 |
| JP | 2013-28915 | | 2/2013 |
| JP | 2013-087423 | A | 5/2013 |
| JP | 5501537 | B1 | 5/2014 |

OTHER PUBLICATIONS

Extended European Search Report issued Nov. 23, 2015 in Patent Application No. 15171000.1.
Japanese Office Action dated Jul. 4, 2017 in Japanese Application No. 2014-130265 with English machine translation (10 pages).

*Primary Examiner* — Gerald McClain
*Assistant Examiner* — Ronald Jarrett
(74) *Attorney, Agent, or Firm* — Oblon, McClelland, Maier & Neustadt, L.L.P.

(57) ABSTRACT

Provided is a construction machine having a plurality of equipment units and a structural body supporting the equipment units, restricting height of each of the equipment units supported by the structural body with no considerable decrease in the strength of the structural body and no considerable restriction on the height dimension of the equipment units. The construction machine includes a structural body having a plurality of beam members, a first equipment unit placed on the structural body, and a second equipment unit which is other than the first equipment unit and placed on the structural body. The plurality of beam members includes a first beam member having a first placement surface on which the first equipment unit is placed and a second beam member having a second placement surface on which the second equipment unit is placed, the second placement surface being lower than the first placement surface.

5 Claims, 5 Drawing Sheets

(56) References Cited

U.S. PATENT DOCUMENTS

| | | | | |
|---|---|---|---|---|
| 2013/0049404 | A1* | 2/2013 | Uesugi | E02F 9/0833 296/203.01 |
| 2015/0090511 | A1 | 4/2015 | Okuda et al. | |
| 2016/0083929 | A1* | 3/2016 | Nakamura | E02F 9/0816 414/687 |

* cited by examiner

CONSTRUCTION MACHINE

TECHNICAL FIELD

The present invention relates to a construction machine such as a hybrid excavator having a plurality of equipment units and a structural body for supporting them.

BACKGROUND ART

There is known a construction machine including a plurality of equipment units and a structural body for supporting the equipment units. For example, Japanese Unexamined Patent Publication No. 2013-28915 discloses an excavator that includes, as the structural body, an upper frame constituting an upper slewing body. The upper frame includes: a center section having a pair of right and left vertical plates; and right and left side decks provided on respective right and left sides of the center section. The right side deck has a front part including a pair of front and rear beam members. Each beam member extends in a lateral direction to allow an equipment unit to be mounted on and across the beam members.

The placement of the equipment unit on the beam members, however, involves a problem in relation to other surrounding structures, depending on the position and height of the equipment unit. For example, the equipment unit, if having a large height dimension, can overlap a boom-foot-pin hole formed in the vertical plate. The height dimension of the equipment unit, therefore, should be restricted. Besides, designing the upper frame so as to locate an placement surface of the equipment unit at a low position in order to secure the height dimension generates a possibility of decreasing the strength of the side deck and/or involving an adverse influence on the layout of other equipment units.

SUMMARY OF INVENTION

An object of the present invention is to provide a construction machine including a plurality of equipment units and a structural body for supporting the equipment units, the construction machine allowing the equipment units supported by the structural body to have restricted height with no considerable decrease in the strength of the structural body and with no considerable restriction on the height dimension of the equipment units.

Provided is a construction machine including a structural body having a plurality of beam members; a first equipment unit placed on the structural body; and a second equipment unit other than the first equipment unit, the second equipment unit placed on the structural body. The plurality of beam members include a first beam member having a first placement surface on which the first equipment unit is placed, and a second beam member having a second placement surface on which the second equipment unit is placed, the second placement surface being lower than the first placement surface.

DESCRIPTION OF EMBODIMENTS

Figure 7:
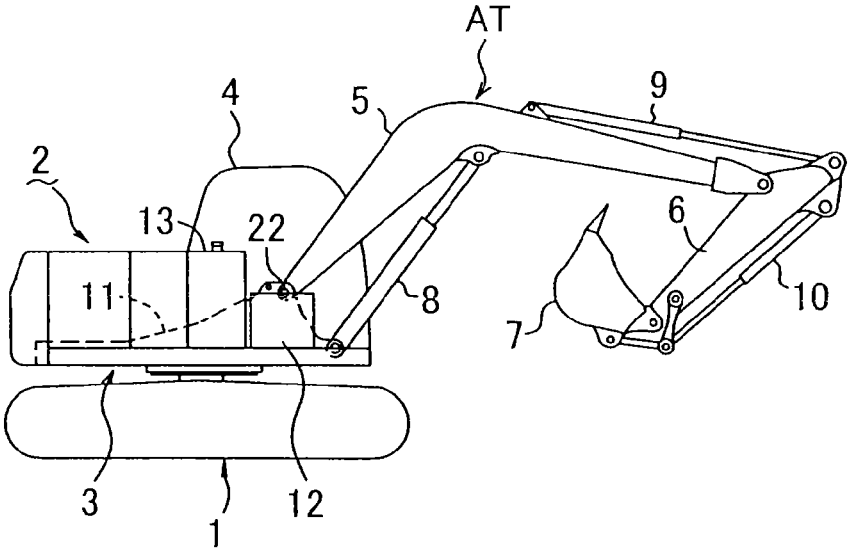
FIG. 7 is a schematic side view of an excavator which is an example of a construction machine to which the present invention is applied.

Prior to describing embodiments of the present invention, will be described an excavator according to a comparative example. As shown in FIG. 7, the excavator includes a crawler-type lower traveling body 1, an upper slewing body 2 mounted on the lower traveling body 1 so as to be slewable about an axis extending perpendicular to the ground surface, and a working attachment AT. The upper slewing body 2 has an upper frame 3 serving as the base thereof and various facilities and equipment units including a cabin 4 mounted on the upper frame 3. The working attachment AT is attached to the front part of the upper frame 3, including a boom 5, an arm 6, a bucket 7, and a plurality of hydraulic cylinders, namely, a boom cylinder 8, an arm cylinder 9, and a bucket cylinder 10 for operating the boom 5, the arm 6, and the bucket 7, respectively. The upper frame 3 has a front-rear direction and the cabin 4 is supported on a left-front part of the upper frame 3.

Figure 8:
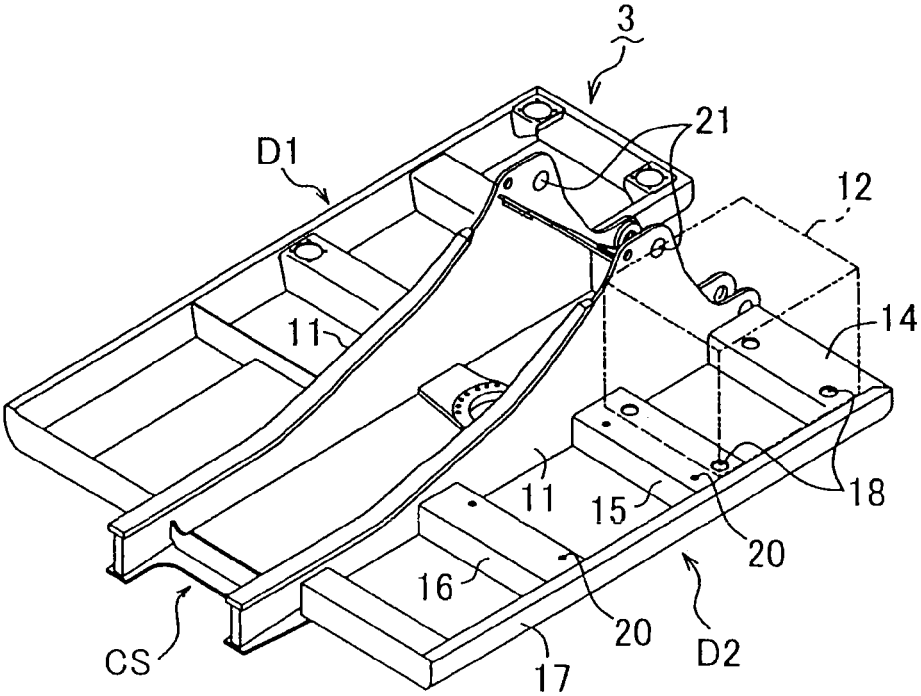
FIG. 8 is a perspective view of an upper frame according to a comparative example of the present invention.
Figure 9:
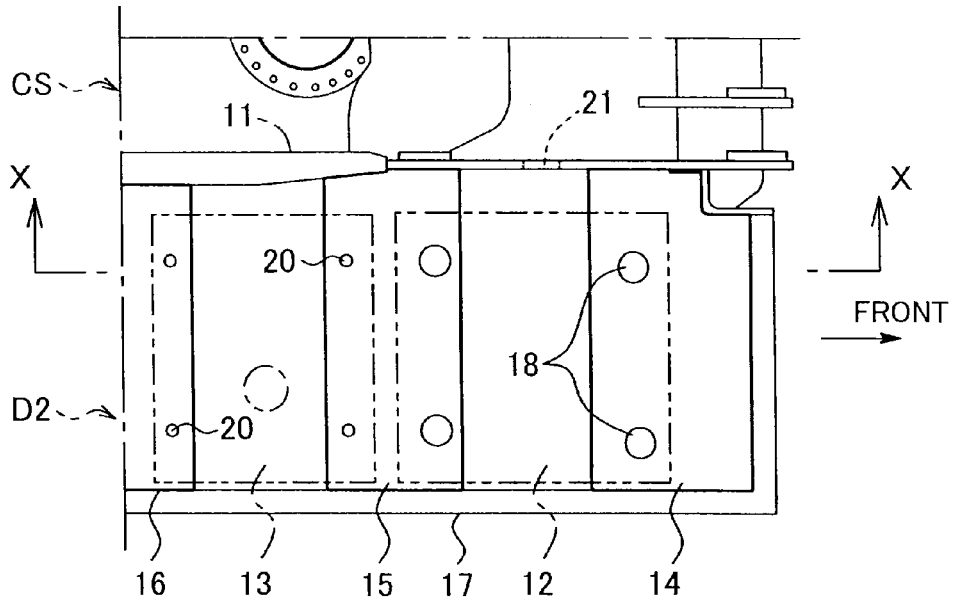
FIG. 9 is a plan view of a portion of the upper frame shown in FIG. 8 at an enlarged scale.
Figure 10:
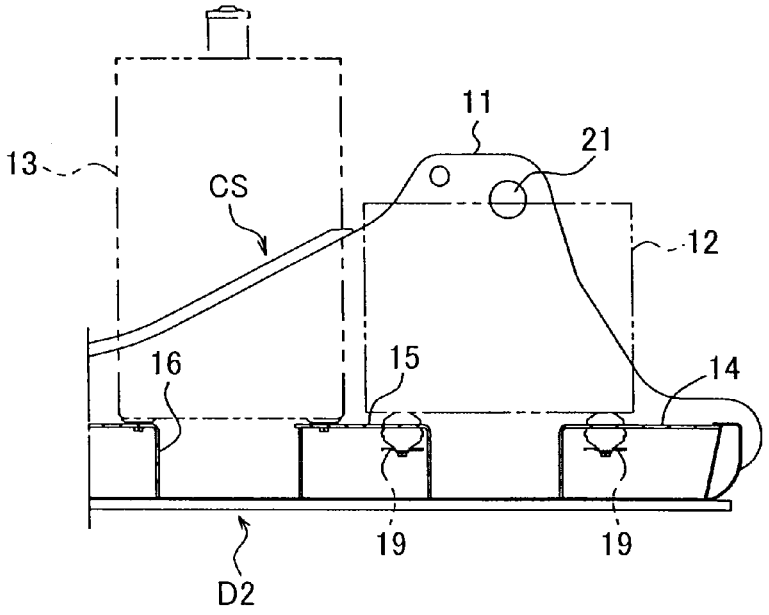
FIG. 10 is a cross-sectional view along line X-X in FIG. 9.

FIGS. 8 to 10 show the upper frame 3 and a plurality of equipment units placed on the upper frame 3.

The upper frame 3 includes a center section CS, a left side deck D1, and a right side deck D2. The center section CS includes a main body and a pair of right and left vertical plates 11, 11 vertically standing on the main body. Each of the vertical plates 11, 11 serves as a reinforcement member and an attachment-mounting member. The left and right side decks D1 and D2 are beam structures provided on the left and right sides of the center section CS, respectively.

The plurality of equipment units includes: a not-graphically-shown power equipment unit provided on the rear part of the center section CS, the cabin 4 shown in FIG. 7 mounted on the left side deck D1, and an equipment unit 12 and a tank 13 which are mounted on the right side deck D2. The equipment unit 12 includes a control unit constituting a hybrid facility and including a electric storage device and an inverter. The tank 13 is, for example, a fuel tank, aligned with the equipment unit 12 in the front-rear direction.

The right side deck D2 includes a plurality of beam members spaced in the front-rear direction: namely, a right frame 17, a first lateral beam 14, a second lateral beam 15, and a third lateral beam, the lateral beams 14, 15, and 16 being aligned in this order from the front side. Each of the first to third lateral beams 14 to 16 extends laterally, i.e., in the right-left direction. The equipment unit 12 is placed on the first and second lateral beams 14 and 15 so as to be placed across the lateral beams 14 and 15. The tank 13 is placed on and across the second and third lateral beams 15 and 16. The right frame 17 extends in the front-rear direction. The lateral beams 14 to 16 are placed between the right vertical plate 11 and the right frame 17, having respective opposite ends which are welded to be fixed to the vertical plate 11 and the right frame 17, respectively. The first to third lateral beams 14 to 16 are depicted by bold lines in FIG. 9.

Each of the first and second lateral beams 14 and 15 is formed with a pair of right and left mount-member attachment holes 18 shown in FIGS. 8 and 9. Into the mount-member attachment holes 18 are fitted respective mount members 19 made of rubber shown in FIG. 10, the equipment unit 12 being placed on the mount members 19. Each of the second and third lateral beams 15 and 16 is formed with a pair of right and left bolt passing holes 20 shown in FIGS. 8 and 9. The tank 13 has a bottom part, which is fixed to the second and third lateral beams 15 and 16 by bolts passing through the bolt passing holes 20 while the tank 13 is placed on the second and third lateral beams 15 and 16.

Each of the vertical plates 11, 11 of the center section CS has a boom-foot-pin hole 21 penetrating through the front ends thereof, allowing a boom foot pin 22 shown in FIG. 7 to be inserted into the boom-foot-pin holes 21 and a hole formed in a boom foot which is the base end of the boom 5. The vertical plates 11, 11 and the boom foot pin 22 support the boom 5 so as to allow the entire working attachment AT including the boom 5 to make rotational movement about the boom foot pin 22, that is, so as to allow the working attachment AT to be raised and lowered.

Placing the equipment units on the beam members as the comparative example can involve problems in relation to other surrounding structures, depending on the position and height of the equipment unit. For example, the equipment unit 12 placed on the right side deck D2 to be located on the right side of the boom-foot-pin hole 21 may allow the upper end of the equipment unit 12 to overlap a portion or an entire portion of the boom-foot-pin hole 21 in a side view as shown in FIG. 10, if having a large height dimension, to thereby cover at least a part of the boom-foot-pin hole 21 on the right side thereof. This disables the boom foot pin 22 from being inserted into and removed from the boom-foot-pin hole 21 for exchanging the attachment or the like, that is, disables the boom 5 from attachment and detachment. The equipment unit 12, therefore, has to be detached from the right side deck D2 for every attachment and detachment of the boom 5.

In order to avoid such a situation, the height dimension of the equipment unit 12 has to be restricted. There may be other countermeasure for lowering the placement surface of the equipment unit 12, that is, locating the entire right side deck D2 or the lateral beams 14 to 16 at a lower position or decreasing the height dimensions thereof these members; however, these may decrease the strength of the right side deck D2 itself or may have an adverse influence on placement of the other equipment units, for example, the tank 13.

The embodiment according to the invention includes structure which eliminates the above inconveniences.

There will be described a first embodiment of the present invention with reference to FIGS. 1 to 6. The first embodiment presents an excavator including a lower traveling body 1, an upper slewing body 2, and a working attachment AT, similarly to the excavator shown in FIG. 7. The upper slewing body 2 includes an upper frame 30 which is a structural body, an equipment unit 12 which is a second equipment unit, and a tank 13 which is a first equipment unit. The equipment unit 12 is, for example, a control unit constituting a hybrid facility.

The upper frame 30 is the same as the upper frame 3 shown in FIGS. 8 to 10 in the following respects.

(i) The upper frame 30 includes a center section 30C including a main body and a pair of right and left vertical plates 31, 31 vertically standing on the main body and serving as a reinforcement member and an attachment-mounting member, and side decks 30R and 30L which are provided on both right and left sides of the center section 30C, respectively to constitute the structural body. There is placed a not-graphically-shown power equipment unit including an engine on the rear part of the center section 30C, and the cabin 4 shown in FIG. 7 is mounted on the left side deck 30L.

(ii) Each of the front ends of respective vertical plates 31, 31 of the center section 30C has a front end formed with a boom-foot-pin hole 32 for attaching the base end of the boom 5 of the working attachment AT shown in FIG. 7.

Figure 3:
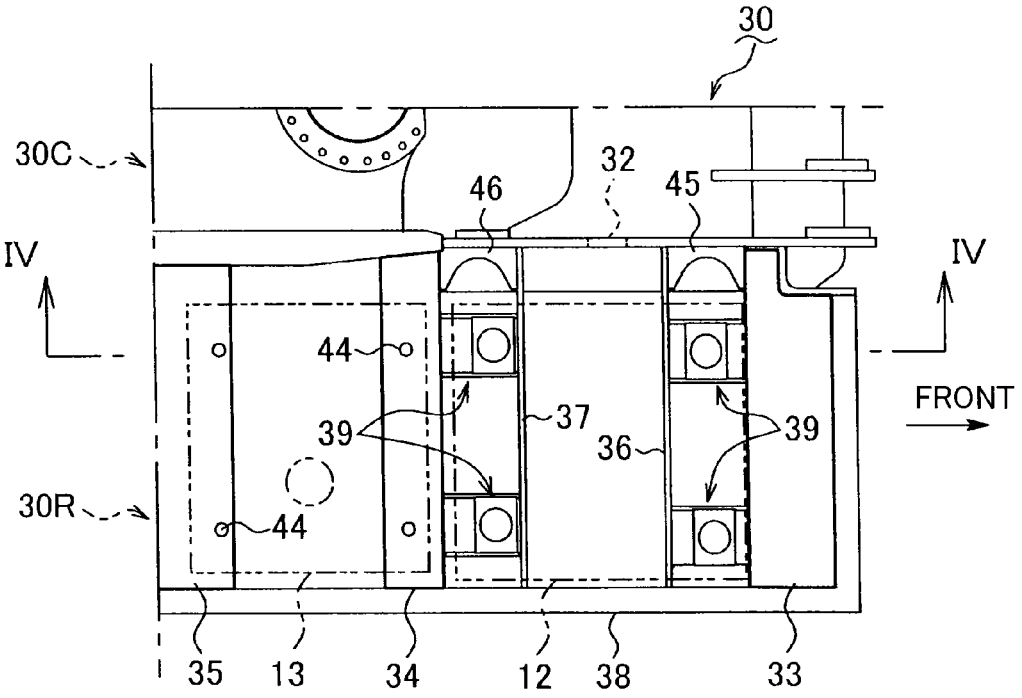
FIG. 3 is a plan view of the portion shown in FIG. 2.

(iii) The right side deck 30R includes a right frame 38 extending in the front-rear direction while being spaced from the right vertical plate 31 in the right-left direction and a plurality of beam members spaced in the front-rear direction, namely, a first lateral beam 33, a second lateral beam 34 and a third lateral beam 35, which are arranged in this order from the front side, as depicted by bold lines in FIG. 3.

(iv) The right side deck 30R is a specific side deck having a front part on which the equipment unit 12 is placed, the tank 13 being placed on the rear side of the equipment unit 12. The tank 13 is placed on and across respective upper surfaces of the second and third lateral beams 34 and 35. Each of the second and third lateral beams 34 and 35 corresponds to a first beam member having a first placement surface, and the tank 13 which is the first equipment unit is placed on the first placement surfaces, that is, respective upper surfaces of the second and third lateral beams 34 and 35. Each of the second and third lateral beams 34 and 35 has a bolt passing hole 44, and the bottom part of the tank 13 is fixed to the second and third lateral beams 34 and 35 by respective bolts inserted into and passing through the bolt passing holes 44.

(v) The equipment unit 12 is located on the right side of the boom-foot-pin hole 32 in a plan view thereof. The equipment unit 12 has such a height dimension that, if the equipment unit 12 was placed directly on and across the upper surfaces of the first and second lateral beams 33 and 34, the upper end of the equipment unit 12 would overlap a part of or all of the boom-foot-pin hole 21 in a side view, that is, would cover at least a part of the boom-foot-pin hole 21 on the right side.

In order to prevent the upper end of the equipment unit 12 from overlapping the boom-foot-pin hole 21, the upper frame 30 according to the first embodiment further includes a second beam member for supporting the equipment unit 12. The second beam member is constructed by utilization of the first and second lateral beams 33 and 34 as a front lateral beam and a rear lateral beam, respectively, further including a front auxiliary beam 36, a rear auxiliary beam 37, and a plurality of equipment-unit attachment members 39.

The front and rear auxiliary beams 36 and 37 are located rearward of the first lateral beam 33 and frontward of the second lateral beam 34 in the right side deck 30R, and are arranged in parallel while spaced from the lateral beams 33 and 34 in the front-rear direction. Each of the front and rear auxiliary beams 36 and 37 has a plate-like shape extending in the right-left direction, disposed in a horizontal attitude making a thickness direction thereof be parallel to the front-rear direction of the upper frame 30. Each of the auxiliary beams 36 and 37, thus, has a modulus of section smaller than that of each of the first and second lateral beams 33 and 34 which are the original constituent elements of the right side deck 30R. Each of the auxiliary beams 36 and 37 has right and left ends which are welded to be fixed to the right side surface of the right vertical plate 31 and the right frame 38, respectively, similarly to the lateral beams 33 to 35. In other words, the first to third lateral beams 33 to 35 and the front and rear auxiliary beams 36 and 37 have respective inner ends which are joined to a common vertical plate 31 of the two vertical plates 31 (in this embodiment, the right vertical plate 31).

Figure 1:
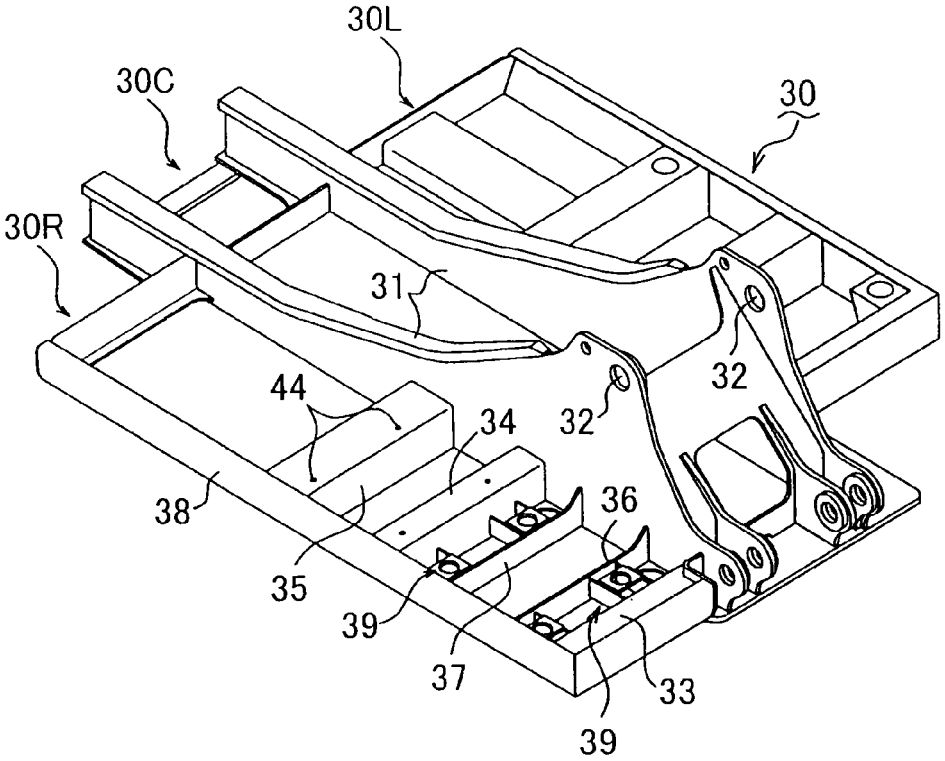
FIG. 1 is a schematic perspective view of an upper frame of an excavator according to a first embodiment of the present invention.
Figure 2:
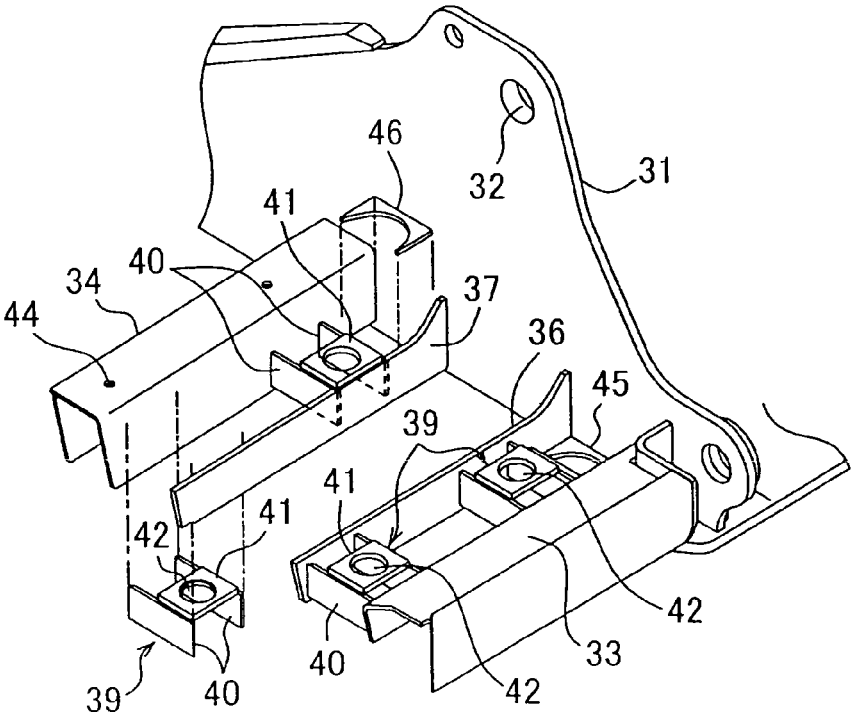
FIG. 2 is an exploded perspective view of a portion of the upper frame shown in FIG. 1 at an enlarged scale.
Figure 4:
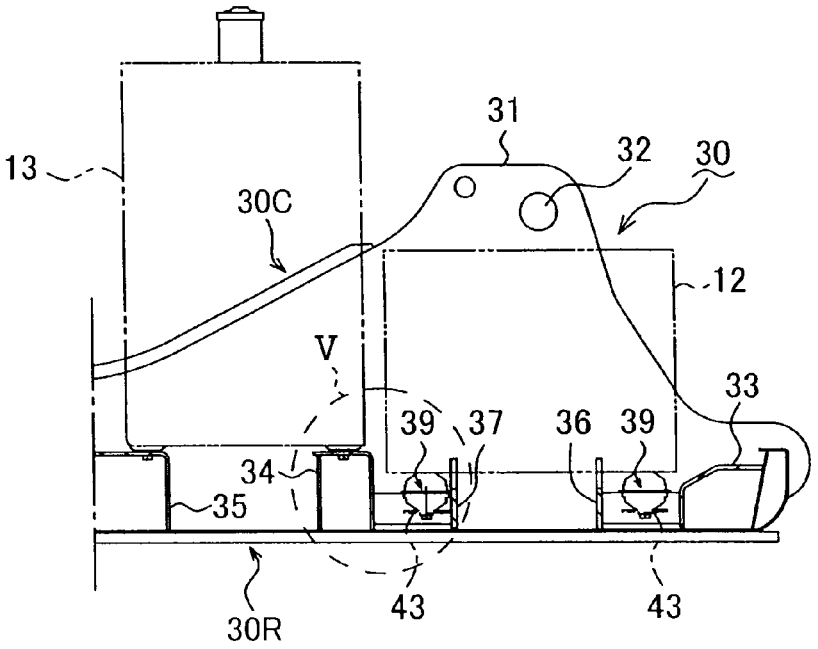
FIG. 4 is a cross-sectional view along line IV-IV in FIG. 3.

The plurality of equipment-unit attachment members 39 is disposed at respective positions aligned in the right-left direction between the first lateral beam 33 and the front auxiliary beam 36 and respective positions aligned in the right-left direction between the second lateral beam 34 and the rear auxiliary beam 37. As shown in FIG. 2, each equipment-unit attachment members 39 includes a pair of right and left support plates 40, 40 disposed in a vertical attitude and a horizontal mounting plate 41 connected to the respective upper ends of both of the support plates 40 across the upper ends. The mounting plates 41 surround respective mount-member attachment holes 42 into which respective mount members 43 shown in FIG. 4 are fitted. The mount members 43 are made of, for example, rubber. The equipment unit 12 is placed on the mount members 43.

The equipment unit 12 according to the first embodiment is, thus, not disposed on the first and second lateral beams 33 and 34 differently from the comparative example but is placed on the mount member 43 and the equipment-unit attachment member 39 located in a region between the first lateral beam 33 and the front auxiliary beam 36 and a region between the second lateral beam 34 and the rear auxiliary beam 37. Each of the front and rear auxiliary beams 36 and 37 and the equipment-unit attachment members 39 serves as a second beam member having a second placement surface, on which, specifically, on the upper surface of the mounting plate 41, the equipment unit 12 which is the second equipment unit is placed.

The "first placement surface" and the "second placement surface" according to the present invention are respective surfaces which closely face the first and second equipment units, respectively. Strictly speaking, the first and second placement surfaces may be separated downward from respective bottom surfaces of the first and second equipment units with a small gap.

Figure 5:
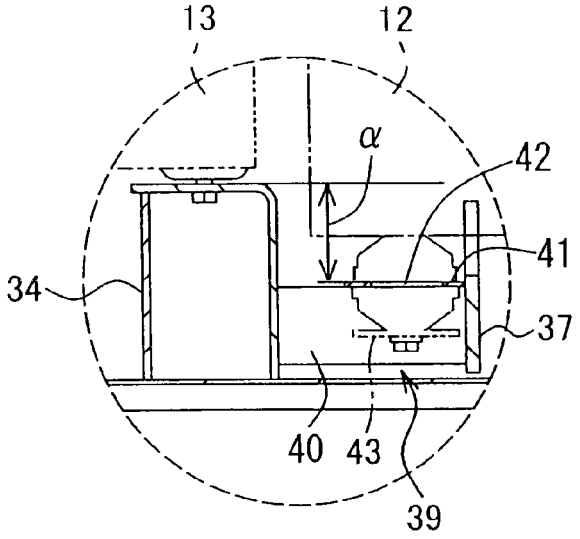
FIG. 5 is an enlarged view of a portion surrounded by circle V in FIG. 4.

Furthermore, as shown in FIG. 5, respective height dimensions and the like of the front and rear auxiliary beams 36 and 37 and the support plate 40 are set so as to make the second placement surface, that is, a surface of the right side deck 30R allowing the equipment unit 12 to be placed thereon, specifically, the upper surface of the mounting plate 41, be lower than the first placement surface, i.e., a surface on which the tank 13 is placed, specifically, respective upper surfaces of the second and third lateral beams 34 and 35.

FIG. 5 shows a height difference a between the upper surface of the mounting plate 41, which is the first placement surface, and the upper surfaces of the second and third lateral beams 34 and 35, which are the second placement surfaces. The height difference a is set to be, for example, approximately half the height dimension of the second lateral beam 34 as shown in the drawing, allowing the bottom surface of the equipment unit 12 to be lower than the bottom surface of the tank 13 by approximately the same dimension as the height difference a. This allows the upper surface of the equipment unit 12 to be located at a lower position than the boom-foot-pin hole 32 as shown in FIG. 4 to thereby prevent the equipment unit 12 from obstructing attachment and detachment of the boom foot pin, with no considerable restriction on the height dimension of the equipment unit 12.

Furthermore, since the equipment-unit attachment members 39 forming the second beam member are disposed across the first and second lateral beams 33 and 34 which are original constituent elements of the right side deck 30R and the added auxiliary beams 36 and 37, the first and second lateral beams 33 and 34 can be utilized as a part of the second beam member, that is, as a supporting member for supporting the equipment unit 12. This allows the structure to be simplified and to have reduced size to reduce cost, as compared to, for example, the case where the second beam member is constituted by only the auxiliary beams 36 and 37.

Besides, the position of each of the mount members 43 is allowed to be adjusted with respect to the front-rear, right-left, and up-down directions by setting the attachment positions of the mounting plates 41 to the support plates 40 and setting the levelness of the mounting plates 41.

The upper frame 30 according to the first embodiment further includes a front reinforcement member 45 and a rear reinforcement member 46 for reinforcement of the basal portions of the respective beam members as shown in FIG. 2. Each of the front and rear reinforcement members 45 and 46 has a horizontal plate-like shape formed with a circular arc-shaped notch opened outward in the right-left direction. The front reinforcement member 45 has front, inner, and rear edges which are linearly shaped to be joined to the rear side surface of the first lateral beam 33, the outer side surface of the right vertical plate 31, and the front side surface of the front auxiliary beam 36, respectively. The rear reinforcement member 46 has front, inner, and rear edges which are linearly shaped to be joined to the rear side surface of the rear auxiliary beam 37, the outer side surface of the right vertical plate 31, and the front side surface of the second lateral beam 34, respectively.

The front and rear reinforcement members 45 and 46, thus including the front, inner, and rear edges to be joined to the first and second lateral beams 33 and 34 and the basal portions of the front and rear auxiliary beams 36 and 37, that is, the portions likely to receive the largest weight load of the equipment unit, can provide excellent reinforcement effect and stress-concentration reduction effect, thereby enabling the upper frame 30 to have efficiently enhanced strength with a simple structure.

The present invention is not limited to the above-described embodiment, including, for example, the following embodiments.

Figure 6:
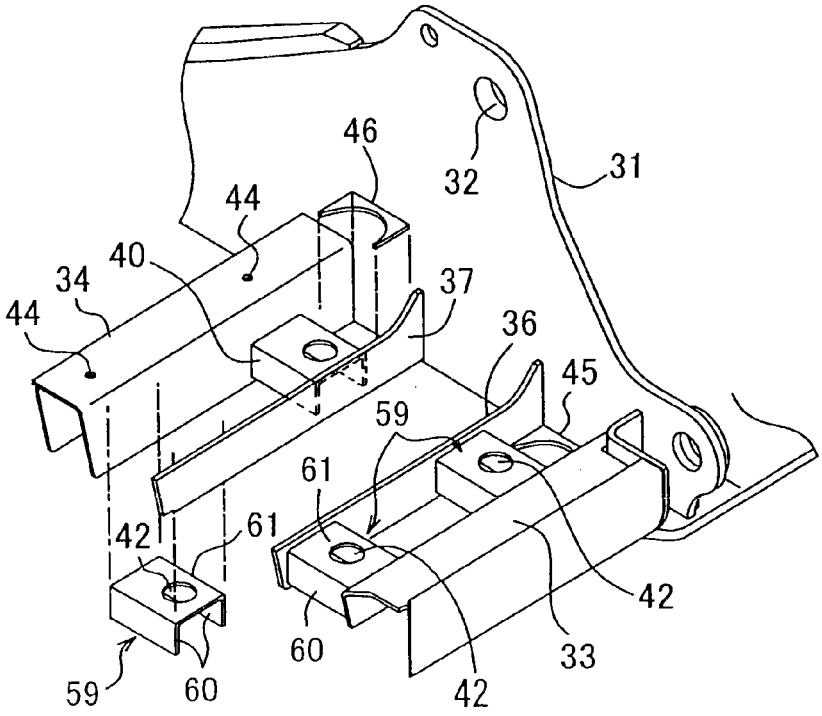
FIG. 6 is an exploded perspective view of a portion of an upper frame according to a second embodiment of the present invention at an enlarged scale.

(1) The equipment-unit attachment member is not limited to the above-described equipment-unit attachment member 39. FIG. 6 shows an upper frame according to a second embodiment, the upper frame including a plurality of equipment-unit attachment members 59 instead of the equipment-unit attachment member 39. Each equipment-unit attachment member 59 includes a pair of support plates 60, 60 and a mounting plate 61, which are similar to the pair of support plates 40, 40 and the mounting plate 41 of the equipment-unit attachment member 39, respectively; however, the support plates 60, 60 and the mounting plate 61 are formed of a single plate member, and respective upper ends of the support plates 60, 60 are integrally joined to the mounting plate 61. This integration makes it possible to reduce cost because of the decreased number of components and to improve the assembly performance. Besides, the equipment-unit attachment member 59 having no welded portion involves no problems due to welding and has the advantage in strength.

(2) The second beam member is not limited to one formed by utilization of already-existing beam member, for example, the first and second lateral beams 33 and 34 in the first embodiment. For example, it is also possible to dispose a pair of right and left auxiliary beams perpendicularly to and between the first and second lateral beams 33 and 34 and to attach the equipment-unit attachment member 39 to the auxiliary beams at the position between the auxiliary beams.

(3) The first and second equipment units may be placed, for example, on the left side deck of the upper frame. Besides, the present invention can be applied to a construction machine which is not an excavator while including a structural body and first and second equipment units placed on the structural body similarly to the embodiment.

As described above, can be provided a construction machine which has a plurality of equipment units and a structural body for supporting the equipment units, the construction machine allowing the equipment units supported by the structural body to have restricted height with no considerable decrease in the strength of the structural body and with no considerable restriction on the height dimension of the equipment units.

Provided is a construction machine including a structural body having a plurality of beam members; a first equipment unit placed on the structural body; and a second equipment unit other than the first equipment unit, the second equipment unit placed on the structural body. The plurality of beam members include a first beam member having a first placement surface on which the first equipment unit is placed, and a second beam member having a second placement surface on which the second equipment unit is placed, the second placement surface being lower than the first placement surface.

This construction machine, in which the second placement surface of the second beam member is lower than the first placement surface of the first beam member, allows the second equipment unit to be lowered with no considerable decrease in strength of the entire structural body and no considerable restriction on the height dimension of the second equipment unit placed on the second placement surface.

The construction machine can be particularly effective, in the case where the construction machine includes: a lower traveling body; an upper slewing body which has an upper frame including the structural body, the upper slewing body mounted on the lower traveling body so as to be slewable; and a working attachment including a boom with a boom foot which is a base end thereof, the boom foot being attached to the upper slewing body, the upper frame including: a center section having a pair of right and left vertical plates extending in a front-rear direction; and a right side deck and a left side deck which are disposed on right and left sides of the center section, respectively, each of the vertical plates having a front end formed with a boom-foot-pin hole for attaching the boom foot to the vertical plate, one of the right and left side decks is a specific side deck including the second placement surface, the second equipment unit being placed on the second placement surface at a position where the second equipment unit is aligned with the boom-foot-pin hole in a right-left direction in a plan view thereof.

In this construction machine, making the position of the second placement surface on which the second equipment unit is placed be lower than that of the first placement surface makes it possible to restrain the second equipment unit from covering the boom-foot-pin hole on the lateral side thereof with no considerable restriction on the height dimension of the second equipment unit.

In this case, it is more preferable that the specific side deck includes: a front lateral beam and a rear lateral beam which are spaced in the front-rear direction in parallel to each other, each of the front and rear lateral beams extending in a right-left direction of the upper frame; a front auxiliary beam and a rear auxiliary beam each extending in parallel to the front lateral beam and the rear lateral beam in a space between the front lateral beam and the rear lateral beam, each of the front auxiliary beam and the rear auxiliary beam having a smaller modulus of section than a modulus of section of each of the front lateral beam and the rear lateral beam; and a plurality of equipment-unit attachment members including a member disposed across the front lateral beam and the front auxiliary beam and a member disposed across the rear lateral beam and the rear auxiliary beam, each of the equipment-unit attachment members having the second placement surface.

In this structure, the plurality of equipment-unit attachment members is supported by a combination of the lateral beam with the large modulus of section and the auxiliary beam having a smaller modulus of section, the second equipment unit placed on the equipment-unit attachment members; this allows the lateral beams to increase the rigidity of the entire specific side deck while allowing the second equipment unit to be supported by a highly efficient structure including the auxiliary beams added thereto and the equipment-unit attachment members.

The front and rear lateral beams and the front and rear auxiliary beams may preferably have respective inner ends that are joined to one of the vertical plates. This structure allows the front and rear lateral beams and the front and rear auxiliary beams to be efficiently supported by a common vertical plate.

In this case, it is more preferable that the construction machine further includes a reinforcement member provided for at least one of the front lateral beam and the rear beam, the reinforcement member including a plurality of edges joined to: the at least one lateral beam; a selected vertical plate which is selected from the pair of right and left vertical plates, the selected vertical plate allowing the inner end of the at least one of the lateral beams to be joined to the selected vertical plates; and a selected auxiliary beam which is selected from the front and rear auxiliary beams, the selected auxiliary beam corresponding to the at least one of the lateral beam, respectively.

For example, each of the equipment-unit attachment members may preferably include: a pair of right and left support plates which are bridged between a mounting lateral beam selected from the front and rear lateral beams and a mounting auxiliary beam selected from the front and rear auxiliary beams, the mounting auxiliary beam corresponding to the mounting lateral beam; and a mounting plate connected to the pair of support plates so as to be disposed across the pair of support plates, the mounting plate allowing a mount member for attaching the second equipment unit to be attached to the mounting plate.

This equipment-unit attachment member enables the position of the mount member attached to the mounting plate to be adjusted with respect to the front-rear, right-left, and up-down directions by setting the position where the mounting plate is attached to the support plate, with respect to the above directions, and setting the levelness of the mounting plate.

Alternatively, for example, each of the equipment-unit attachment members may preferably include: a pair of right and left support plates which are bridged between a mounting lateral beam selected from the front and rear lateral beams and a mounting auxiliary beam selected from the front and rear auxiliary beams, the mounting auxiliary beam corresponding to the mounting lateral beam; and a mounting plate connected to the pair of support plates so as to be disposed across the pair of support plates, the mounting plate allowing a mount member for attaching the second equipment unit to be attached to the mounting plate, the pair of support plates and the mounting plate being formed of a single plate member.

This structure allows cost to be reduced because of the decreased number of components and allows the assembly performance to be improved. Besides, the equipment-unit attachment member having no welded portion involves no problem due to welding.

This application is based on Japanese Patent application No. 2014-130265 filed in Japan Patent Office on Jun. 25, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a lower traveling body;

an upper slewing body having an upper frame including a structural body including a plurality of beam members, the upper slewing body mounted on the lower traveling body so as to be slewable;

a working attachment including a boom with a boom foot which is a base end thereof, the boom foot being attached to the upper slewing body;

a first equipment unit placed on the structural body; and a second equipment unit other than the first equipment unit, the second equipment unit placed on the structural body, wherein the plurality of beam members provide a first placement surface on which the first equipment unit is placed, and a second placement surface on which the second equipment unit is placed, the second placement surface being lower than the first placement surface;

the upper frame includes a center section having a pair of right and left vertical plates extending in a front-rear direction and a right side deck and a left side deck which are disposed on right and left sides of the center section, respectively;

each of the vertical plates has a front end formed with a boom-foot-pin hole for attaching the boom foot to the vertical plate;

one of the right and left side decks is a specific side deck including the second placement surface;

the second equipment unit is placed on the second placement surface at a position where the second equipment unit is aligned with the boom-foot-pin hole in a right-left direction in a plan view thereof; and the specific side deck includes:

a front lateral beam disposed on a front side of the boom-foot pin hole, the front lateral beam having a first modulus of section, and a rear lateral beam disposed on a rear side of the boom-foot pin hole, the rear lateral beam having a second modulus of section, the front lateral beam and the rear lateral beam being spaced in the front-rear direction in parallel to each other, each of the front and rear lateral beams extending in a right-left direction of the upper frame;

a front auxiliary beam and a rear auxiliary beam each extending in parallel to the front lateral beam and the rear lateral beam in a placement space between the front lateral beam and the rear lateral beam, the second placement surface being formed in the placement space, each of the front auxiliary beam and the rear auxiliary beam having a smaller modulus of section than the first modulus of section and the second modulus of section; and a plurality of equipment-unit attachment members including a first support member disposed across the front lateral beam and the front auxiliary beam and a second support member disposed across the rear lateral beam and the rear auxiliary beam, thereby locating the second placement surface, in a front inter-boom region between the front lateral beam and the front auxiliary beam and a rear inter-boom region between the rear lateral beam and the rear auxiliary beam, at a position lower than respective upper surfaces of the front lateral beam and the rear lateral beam, each of the equipment-unit attachment members having the second placement surface.

2. The construction machine according to claim 1, wherein the front and rear lateral beams and the front and rear auxiliary beams have respective inner ends that are joined to one of the vertical plates.

3. The construction machine according to claim 2, further comprising a reinforcement member provided for at least one of the front lateral beam and the rear lateral beam, the reinforcement member including a plurality of edges joined to: the at least one lateral beam; a selected vertical plate which is selected from the pair of right and left vertical plates, the selected vertical plate allowing the inner end of the at least one of the lateral beams to be joined to the selected vertical plate; and a selected auxiliary beam which is selected from the front and rear auxiliary beams, the selected auxiliary beam corresponding to the at least one of the lateral beam, respectively.

4. The construction machine according to claim 1, wherein each of the equipment-unit attachment members includes: a pair of right and left support plates which are bridged between a mounting lateral beam selected from the front and rear lateral beams and a mounting auxiliary beam selected from the front and rear auxiliary beams, the mounting auxiliary beam corresponding to the mounting lateral beam; and a mounting plate connected to the pair of support plates so as to be disposed across the pair of support plates, the mounting plate allowing a mount member for attaching the second equipment unit to be attached to the mounting plate.

5. The construction machine according to claim 1, wherein each of the equipment-unit attachment members includes: a pair of right and left support plates which are bridged between a mounting lateral beam selected from the front and rear lateral beams and a mounting auxiliary beam selected from the front and rear auxiliary beams, the mounting auxiliary beam corresponding to the mounting lateral beam; and a mounting plate connected to the pair of support plates so as to be disposed across the pair of support plates, the mounting plate allowing a mount member for attaching the second equipment unit to be attached to the mounting plate, the pair of support plates and the mounting plate being formed of a single plate member.

* * * * *